United States Patent [19]

Smith

[11] 4,085,301

[45] Apr. 18, 1978

[54] HAND-HELD CONTROLLER DEVICE

[75] Inventor: Ronald A. Smith, Los Gatos, Calif.

[73] Assignee: Fairchild Camera and Instrument Corporation, Mountain View, Calif.

[21] Appl. No.: 724,044

[22] Filed: Sep. 16, 1976

[51] Int. Cl.[2] ..... H01H 25/00

[52] U.S. Cl. ..... 200/4; 200/6 A; 200/18; 200/157

[58] Field of Search ..... 200/4, 6 A, 18, 157

[56] References Cited

U.S. PATENT DOCUMENTS

| | | | |
|---|---|---|---|
| 1,717,629 | 6/1929 | Sawyer | 200/6 A X |
| 2,622,161 | 12/1952 | Harter, Jr. | 200/6 A |
| 2,841,659 | 7/1958 | Eitel | 200/6 A X |
| 3,223,792 | 12/1965 | Strother, Jr. | 200/6 A |
| 3,293,381 | 12/1966 | Eitel | 200/6 A |
| 3,365,975 | 1/1968 | Hathaway | 200/6 A X |
| 3,669,533 | 6/1972 | DeAngelis | 200/4 |
| 3,731,013 | 5/1973 | Nightengale | 200/4 |
| 3,978,296 | 8/1976 | Moriya et al. | 200/4 |

*Primary Examiner*—James R. Scott

*Attorney, Agent, or Firm*—Alan H. MacPherson; Henry K. Woodward; Robert C. Colwell

[57] ABSTRACT

A hand-held controller device including a two-piece outer housing shaped to be held in one hand of the user, an internal cylinder pivoted at one end and adapted to telescopically receive an elogated plunger from the other end, the plunger having a contact pin attached to the received end and a hand grip knob affixed to its other end. A first plurality of switch contacts are carried by the cylinder so as to engage a stationary contact in response to the pivotal positioning of the cylinder, and a second plurality of contact elements are also carried by the cylinder and engaged by the contact pin in response to the longitudinal positioning and the rotational positioning of the plunger.

7 Claims, 6 Drawing Figures

HAND-HELD CONTROLLER DEVICE

BACKGROUND OF THE INVENTION

1. Field of the Invention

The present invention relates generally to control apparatus, and more particularly to a hand-held controller device for enabling an operator to manually input control information into an electronic control unit.

2. Description of the Prior Art

In prior art systems in which an operator is to insert control information into an electronics system to cause certain operations to be accomplished by the system that are directly related to the operator input, a "joy stick" type of input controller is frequently utilized. Such devices are typically comprised of a handle, or joy stick, which has one end affixed to a gimballed set of potentiometers that develop analog-type electrical responses depending upon the position into which the joy stick is moved about its pivot point.

Although the output obtainable from such devices normally provides relatively accurate position control information, such devices usually suffer from the disadvantages of mechanism complexity, relatively short lifetime due to friction wearing of engaging parts, hysterisis problems and relatively high cost. Moreover, the number of control inputs which can be incorporated in a single joy stick device are practically limited by mechanical complexity.

Another important limitation is that the gimballed potentiometer structure is bulky and fragile, and thus not suited for hand-held remote control applications. As a result, the control must be incorporated into some type of chassis.

SUMMARY OF THE PRESENT INVENTION

It is therefore a principal object of the present invention to provide a novel control input device which is easy to use, mechanically simple, relatively inexpensive and easy to manufacture.

Another object of the present invention is to provide a controller mechanism which responds to movement of a single joy stick to develop a multiplicity of control function signals.

Still another object of the present invention is to provide a compact controller mechanism which is of rugged construction and can be incorporated into a small, hand-held housing.

Briefly, the preferred embodiment includes a two-piece outer housing shaped to be held in one hand of the user, an internal cylinder pivoted at one end and adapted to telescopically receive an elongated plunger from the other end. The plunger has a contact pin attached to the received end and a hand grip knob affixed to its other end. A first plurality of switch contacts is carried by the cylinder so as to engage a stationary contact in response to the pivotal positioning of the cylinder. A second plurality of contact elements is also carried by the cylinder and is engaged by the contact pin in response to the longitudinal positioning and the rotational positioning of the plunger. Eight separate switches are included in the preferred embodiment but through appropriate logical interconnection thereof, more than 30 switching functions can be accomplished.

Among the important advantages of the present invention is that it is simple to manufacture and is thus relatively inexpensive. Furthermore, it is compact, rugged and has electrical contacts which are not subject to substantial wear.

These and other advantages of the present invention will no doubt become apparent to those skilled in the art after having read the following detailed description of a preferred embodiment which is shown in the several figures of the drawing.

IN THE DRAWING

DETAILED DESCRIPTION OF THE PREFERRED EMBODIMENT

Figures 1, 2, 3, 4, 5, 6:
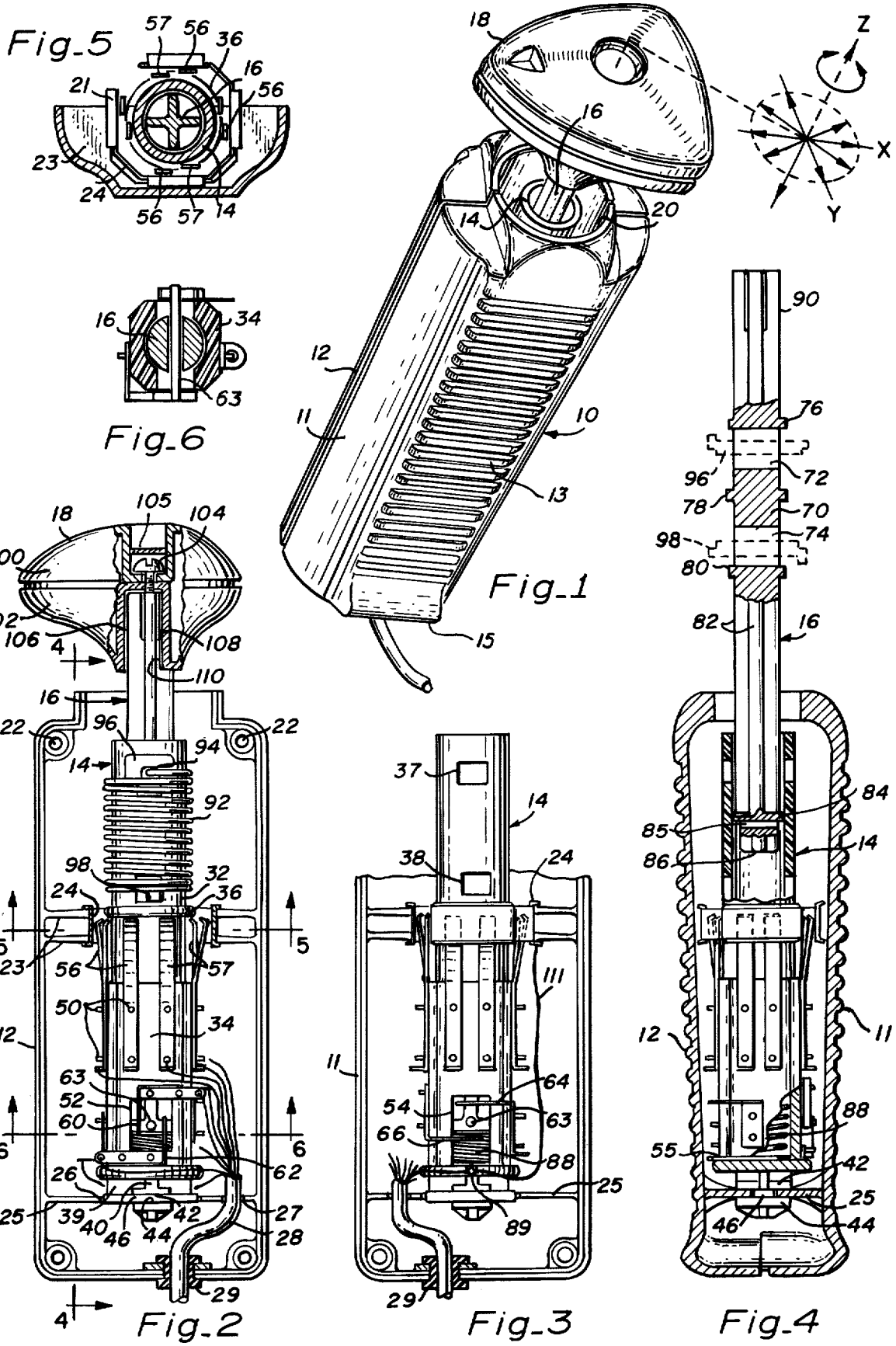
FIG. 1 is a perspective view showing a hand-held controller device in accordance with the present invention.
FIG. 2 is a front elevation of the controller shown in FIG. 1 with the front cover member removed.
FIG. 3 is a partially broken rear elevation of the controller of FIG. 1 showing the internal cylinder in position in the front cover member with the rear cover member and other components removed for clarity.
FIG. 4 is a partially broken section taken along the line 4—4 of FIG. 2 showing one side of the internal cylinder with the plunger partially withdrawn.
FIG. 5 is a partial cross section taken along the line 5—5 of FIG. 2.
FIG. 6 is a partial cross section taken along the line 6—6 of FIG. 2.

In FIG. 1 of the drawing, a hand-held controller device in accordance with the present invention is illustrated which includes an outer housing 10 comprised of a front cover member 11 and a back cover member 12, a contact carrying cylinder 14, a switch closing plunger rod 16, and a hand grip or knob 18. As illustrated, the housing 10 is configured in what may be described as a pistol grip configuration having serrations 13 and a flared tail portion 15 on each side. Housing 10 also includes a relatively large circular opening 20 at the upper end thereof to permit lateral movement of the members 14-18. As will be explained in more detail below, knob 18 can be rocked from side-to-side in any lateral direction relative to housing 10. Furthermore, it can be rotated about the axis of plunger 16 and it can be translated, i.e., lifted and depressed, along the axis of plunger 16. Such motions are illustrated by the arrows shown to the right of knob 18 to indicate that there are eight switching movements which can be accomplished in the X-Y plane, two switching movements can be accomplished along the Z axis, i.e., the longitudinal axis of plunger 16, and two switching movements can be accomplished by rotating knob 18 clockwise and counterclockwise about the Z axis.

Accordingly, without a logical coupling of the several switching functions, discrete control signals can be generated. On the other hand, by logically coupling the Z axis longitudinal movement sensing contacts and/or the Z axis rotational movement sensing contacts with the X-Y plane movement sensing contacts, at least 32 additional control signals can be generated, i.e., eight X-Y plane contacts coupled with an "up" Z contact, eight X-Y plane contacts coupled with a "down" Z contact, etc.

Turning now to FIGS. 2, 3 and 4, the internal parts of housing 10 and the components of the device which are enclosed within housing 10 will be described in detail. The interior parts of cover members 11 and 12 are substantially mirror images of each other except that the mating outer edges of each are oppositely offset so as to form an interlocking fit and the four screw holes 22 on one member are tapped while those on the other member are simply bored and countersunk. Disposed slightly above the middle of the members are a pair of spaced apart, integrally formed ribs 23 (see also FIG. 5) which are adapted to support a ground ring 24. The ground ring 24 is a continuous strip of metal having four contact segments with turned edges 21 which form a saddle for mating with the ribs 23. Near the lower end of each member is another rib 25 having a centrally located rectangular cut-out 26, which, as will be described more fully below, serves as part of a pivot structure for cylinder 14. The ribs 25 also have a smaller cut-out 27 for receiving the wiring cable 28. Another cut-out 29 is also provided at the lower end of each member to accommodate cable 28.

The cylinder 14 is an elongated molded member made of polycarbonate or some other suitable nonconductive plastic material and has an upper portion 32 with a cylindrical outer surface and a lower portion 34 with a generally square cross section with bevelled corners (see also FIG. 6). Portion 32 is provided with a circular contact protection band or shoulder 36 and has a pair of apertures 37 and 38 which are best shown in FIG. 3, and which extend through both sides of the cylinder.

The lower end of cylinder 14 terminates in a pivot forming structure which includes a transversely extending vertical rib 39, a shorter rib 40 (see FIG. 4) which is transverse to rib 39, a pair of spaced-apart bearing surfaces 42 and 44, and a pivot web 46. The web 46 is received within the opening 26 formed between the ribs 25 of members 11 and 12, as is perhaps best illustrated in the broken section of FIG. 4, with the surfaces 42 and 44 disposed on opposite sides of the ribs 25. The spacing between surfaces 42 and 44 is approximately twice the thickness of rib 25 so as to provide adequate freedom of movement.

Molded to the sides of portion 34 are 26 studs 50 which serve as anchoring means for various springs and contacts as will be described below. Portion 34 also has an aperture 52 on its front side and an aperture 54 on its back side. Aperture 54 extends to the bottom of the central bore of cylinder 14 and there is a narrow slot 55 formed in the bottom surface and extending out of aperture 54. Four leaf-type spring members 56 are attached to cylinder portion 34 by slipping openings formed therein over the studs 50. Fastening thereto may either be made by a friction fit or the studs 50 may be heat-staked to secure the spring members in place. Note that the spring members 56 are sprung outwardly so as to bear against the ground ring 24 and thus maintain the cylinder 14 in a centered position relative to housing 10. Four metallic contact members 57 which are similar to spring members 56 are similarly affixed to portion 34 by studs 50. In the preferred embodiment the flexing end of spring members 56 are deflected outwardly approximately 0.190 inches.

The contact members 57 differ from spring members 56 in that their flexing ends are only deflected approximately 0.070 inch. Accordingly, when cylinder 14 is centered by members 56 none of the contacts 57 will touch the grounding ring 24. However, a lateral movement of cylinder 14 will spring members 56 enough to allow one or more of the contacts 57 to engage ring 24. The diameter of shoulder 36 is chosen so that it engages ring 24 slightly after the contacts 57 engage the ring and thus serves to prevent overstressing of tthe contact members due to excessive lateral forces applied to cylinder 14.

A pair of contact members 60 and 62 are likewise attached to the studs extending from the surface above and below aperture 52 and include contact arms which extend over opening 52 on each side thereof. As will be explained in more detail below, the arms will be contacted by a ground pin 63 in response to clockwise and counterclockwise rotation of knob 18. As illustrated in FIG. 3 of the drawing, another pair of contacts 64 and 66 are mounted to studs 50 on each side of cylinder 14 and include contact arms which extend over the opening 54 on the back side of cylinder 14. These contact arms are positioned above and below the other end of pin 63 and are contacted thereby in response to upward and downward movement of knob 18.

In FIG. 4 the plunger 16 is shown partially withdrawn from cylinder 14 with part of cylinder 14 broken away as well as part of 16 being broken away to illustrate certain features. As depicted, plunger 16 includes a cylindrical mid-section 70 having two apertures 72 and 74 extending transversely therethrough, three circular bearing shoulders 76, 78 and 80 disposed at the ends and center of the section, and end sections comprised of four orthogonally disposed longitudinally extending ribs 82. A fourth bearing ring 84 is also provided near the lower end of the plunger. Ring 84 has a transversely extending bore 85 provided therein for receiving ground pin 63. The lower end 86 of plunger 16 is adapted to receive a helical ground spring 88 that is disposed in the bottom of the cylinder. The upper end section 90 of plunger 16 is tapered somewhat to receive knob 18 and as shown in FIG. 2, one of the ribs is deformed so as to provide a locating key for insuring that knob 18 is mated to the plunger with the correct orientation. The ground spring 88 has its lower end 89 bent along a diameter of the spring and extended to form a wiring connection. As indicated in FIG. 3, the spring end 89 seats in slot 55 and extends through opening 54.

Referring now back to FIG. 2 of the drawing, it will be noted that a helical torsion spring 92 is mounted to the upper portion 32 of cylinder 14 and is held in place by a pair of keys 96 and 98 which extend through the apertures 37 and 38 in cylinder 14 and through the apertures 72 and 74 in plunger 16. The upper end 94 of spring 92 is turned radially inwardly and inserted into a hole in the end of key 96. Similarly, the lower end of spring 92 is inserted into a hole in the end of key 98. The apertures 37 and 38, and 72 and 74 are configured and aligned such that they cooperate with the keys 96 and 98 and spring 92 to resiliently bias plunger 16 into a rest position wherein ground pin 63 is centered between contact arms 60 and 62, and 64 and 66, yet permit plunger 16 to be moved up and down and be rotated clockwise and counterclockwise sufficient to cause pin 63 to engage the respective contact arms.

The knob 18 is comprised of upper and lower molded shells 100 and 102 which are mated together and secured to the end of plunger 16 by a screw 104 which passes through apertures in both the upper and lower shelves and is threaded into the end of plunger 16. In order to insure that the knob is always properly oriented relative to plunger 16, the four-sided socket 106 has one side 108 which is shorter than the others to match the corresponding narrowed rib 110 of plunger 16.

The ground pin 63 extends through the bore 85 (see FIG. 4) in plunger 16 and as previously mentioned serves as a contact for engaging arms 60 and 62 as knob 18 is rotated about the Z axis and for engaging arms 64 and 66 when knob 18 is either depressed or pulled upward. Electrical contact to ground pin 63 is made through spring 88, the upper end of which bears directly against the pin. The other end extends through the aperture 54 for attachment to the ground conductor of cable 28 and is also connected to ground ring 24 by a conductor 111. In FIG. 2 the conductors of cable 28 leading to the eight switching contacts are illustrated. The ninth conductor is connected to spring end 89 as indicated in FIG. 3.

A further understanding of the simplicity of the present invention is apparent from a description of the assembly procedure. The first step in the assembly is to place ground spring 88 into cylinder 14 so that its connecting end 89 slips into slot 55 and extends out of opening 54. Plunger 16 is then inserted into cylinder 14 so that its end 86 is received within spring 88. Plunger 16 is pushed down against spring 88 far enough so that ground pin 63 can be inserted through the hole 85. The bottom key 98 is then inserted through the apertures 38 and 74. Next, the coil spring 92 is placed over the end of cylinder 14 and its inwardly-bent end is inserted into a hole in the end of key 98. Spring 92 is then pressed down and the top key 96 is inserted through openings 37 and 72, and the inwardly-turned upper end of spring 92 is rotated 270° from its unsprung position and inserted into a hole in the end of key 96.

At this point the conductors of the cable assembly 28 are soldered to the various contact elements according to a particular color code and the contact elements are pushed onto the studs 50 of cylinder 14. The ground ring 24 is then placed over the cylinder and one end of a ground wire 111 (FIG. 3) is soldered to ring 24 and the other end is soldered to the end 89 of ground spring 88. End 89 is also soldered to the ground wire of the cable 28. The cylinder assembly and ground ring are then placed into the back cover member 12 with the ground ring being properly located over the ribs 23. The front cover 11 is subsequently carefully placed over the cover 12 with care being taken to make sure that the ribs 23 and ground ring flanges 21 are aligned. The two covers are secured together by four screws inserted into the openings 22.

The upper and lower knob parts 100 and 102 are then mounted over the end 90 of plunger 16 and are affixed thereto by a screw 104. A label plug 105 is then placed into the screw recess to hide screw 104 from view. At this point, the controller device is fully assembled and is ready for connection to any electrical or electronic apparatus capable of being controlled thereby.

One particular application for which the present embodiment is found highly suited is in video game apparatus wherein two or more of the devices are attached to an electronic control and signal generating system for producing video game displays on the cathode ray tube of a standard television set. In such application the eight switches provide twelve control inputs to the system; namely, eight directional inputs corresponding to the eight arrows shown in the X-Y plane of FIG. 1, two rotational inputs as shown by the double-headed arrow circumscribing the Z axis in FIG. 1, and two arbitrary inputs effected by pressing down or pulling up knob 18 as illustrated by the two arrows along the Z axis. However, as mentioned above, many more control inputs could be provided for by logically coupling the laterally, rotationally and translationally responsive switches.

Although the present invention has been described in terms of a single preferred embodiment, it is contemplated that many alterations and modifications thereof will become apparent to those skilled in the art after having read the above disclosure. Whereas the illustrated preferred embodiment includes a streamlined housing suitable for being held in one hand of a user while the other hand moves the knob 18, it is to be understood that an equivalent housing could just as well be fixed to a chassis, table or other support, or could even be made an integral part thereof. Moreover, it is contemplated that certain applications or manufacturing considerations may make it desirable to mount the switch contact members 57 and/or the spring members 56 to the housing cover members rather than to the cylinder 14. Additionally, it may be found that a simple slide-coupling mechanism permitting lateral movement of cylinder 14 is preferable to the pivot structure shown in the drawing. Accordingly, it is intended that the appended claims be interpreted as covering all such alterations and modifications as fall within the true spirit and scope of the invention.

What is claimed is:

1. A controller device comprising:

an outer housing having an opening therein;

an elongated generally cylindrical member having a bore extending longitudinally therein from one end thereof and having pivot means pivotally securing the other end thereof to said housing, said member being disposed within said housing with said one end disposed proximate said opening;

first resilient means for normally biasing said cylindrical member into a rest position but permitting said one end to be moved laterally relative to the longitudinal axis of said cylindrical member;

first switching means disposed around said cylindrical member so as to be actuated by said lateral movement of said one end and including at least four lateral contact members carried by said cylindrical member, and fixed contact means carried by said housing, whereby said lateral movement of said one end of said cylindrical member in any direction causes at least one of said lateral contact members to engage said fixed contact means;

plunger means including an elongated rod having a first end disposed within said bore and a second end extending out of said housing through said opening;

second resilient means for normally biasing said plunger means into a predetermined position relative to said cylindrical member but permitting said plunger means to be both rotated about its longitudinal axis and translated therealong;

second switching means affixed to said cylindrical member and actuated by translational axial movement of said plunger means; and third switching means affixed to said cylindrical member and actuated by rotational motion of said plunger means, whereby lateral, translational or rotational forces applied to said second end of said plunger means cause said first, second and third switching means to develop corresponding signals.

2. A controller device as recited in claim 1 wherein said first resilient means includes a plurality of leaf spring elements each having one end affixed to said cylindrical member and an opposite end bearing against said fixed contact means.

3. A controller device as recited in claim 1 wherein said second switching means includes a rotatable contact member carried by said plunger means and a first pair of contact members carried by said cylindrical member and disposed one on each side of said rotatable contact member so that rotation of said plunger causes said rotatable member to engage one of said first pair of contact members.

4. A controller device as recited in claim 3 wherein said third switching means includes another contact member carried by said plunger means and a second pair of contact members carried by said cylindrical member and disposed one above and one below said other contact member so that longitudinal translation of said plunger means causes said other contact member to engage one of said second pair of contact members.

5. A controller device as recited in claim 4 wherein said rotatable contact member and said other contact member are comprised of opposite ends of a conductive pin extending through said first end of said plunger means.

6. A controller device as recited in claim 5 and further comprising a conductive coil spring disposed within said bore and about said first end of said plunger means, said coil spring having one end serving as an electrical terminal and the other end engaging said pin thereby providing an electrically conductive coupling to said pin.

7. A hand-held controller device comprising:

an outer housing having an opening therein;

an elongated generally cylindrical member having a bore extending longitudinally therein from one end thereof and having pivot means pivotally securing the other end thereof to said housing, said member being disposed within said housing with said one end disposed proximate said opening;

first resilient means for normally biasing said cylindrical member into a rest position but permitting said one end to be moved laterally relative to the longitudinal axis of said cylindrical member;

first switching means disposed around said cylindrical member so as to be actuated by said lateral movement of said one end and including plunger means including an elongated rod having a first end disposed within said bore and a second end extending out of said housing through said opening;

second resilient means for normally biasing said plunger means into a predetermined position relative to said cylindrical member but permitting said plunger means to be both rotated about its longitudinal axis and translated therealong;

second switching means affixed to said cylindrical member and actuated by translational axial movement of said plunger means;

third switching means affixed to said cylindrical member and actuated by rotational motion of said plunger means, whereby lateral, translational or rotational forces applied to said second end of said plunger means causes said first, second and third switching means to develop corresponding signals;

said cylindrical member has a first pair of spaced apart openings extending transversely therethrough, said plunger means has a second pair of spaced apart openings extending transversely therethrough, and wherein said second resilient means includes a coil spring and a first key attached to one end of said coil spring and disposed within one of said first openings and the corresponding one of said second openings, and a second key attached to the other end of said coil spring and disposed within the other of said first openings and the corresponding one of said second openings, said first and second openings and said first and second keys being dimensioned so as to permit said plunger means to be axially translated and rotated sufficient to actuate said second and third switching means respectively.

* * * * *